US008702827B2

(12) United States Patent
Schultink et al.

(10) Patent No.: US 8,702,827 B2
(45) **Date of Patent: *Apr. 22, 2014**

(54) FLAT BAG FOR VACUUM CLEANERS

(75) Inventors: Jan Schultink, Overpelt (BE); Ralf Sauer, Overpelt (BE)

(73) Assignee: Eurofilters Holding N.V., Overpelt (BE)

( * ) Notice: Subject to any disclaimer, the term of this patent is extended or adjusted under 35 U.S.C. 154(b) by 36 days.

This patent is subject to a terminal disclaimer.

(21) Appl. No.: 13/377,656

(22) PCT Filed: Jun. 11, 2010

(86) PCT No.: PCT/EP2010/003524

§ 371 (c)(1),
(2), (4) Date: Feb. 15, 2012

(87) PCT Pub. No.: WO2010/145783

PCT Pub. Date: Dec. 23, 2010

(65) Prior Publication Data

US 2012/0131890 A1 May 31, 2012

(30) Foreign Application Priority Data

Jun. 19, 2009 (EP) ..... 09008065

(51) Int. Cl.
*B01D 46/02* (2006.01)

(52) U.S. Cl.
USPC ..... 55/309; 55/367; 55/368; 55/372; 55/374; 55/382; 55/486; 55/DIG. 2; 55/DIG. 5; 15/347; 15/352; 15/353; 96/222; 96/223; 96/226; 96/227

(58) Field of Classification Search
USPC ..... 55/309, 367, 368, 372, 374, 382, 486, 55/DIG. 2, DIG. 5; 15/347, 352, 353; 96/222, 223, 226, 227
See application file for complete search history.

(56) References Cited

U.S. PATENT DOCUMENTS

| | | | | |
|---|---|---|---|---|
| 6,063,171 | A | 5/2000 | Moyher, Jr. et al. | |
| 8,066,803 | B2 * | 11/2011 | Sauer et al. | 96/223 |
| 8,092,562 | B2 * | 1/2012 | Sauer et al. | 55/367 |
| 8,236,078 | B2 * | 8/2012 | Rosemeier et al. | 55/382 |
| 8,372,174 | B2 * | 2/2013 | Schultink et al. | 55/365 |
| 8,449,639 | B2 * | 5/2013 | Sauer et al. | 55/367 |
| 2008/0314005 | A1 | 12/2008 | Sauer et al. | |
| 2009/0031681 | A1 | 2/2009 | Linhart et al. | |
| 2009/0301043 | A1 | 12/2009 | Rosemeier et al. | |

FOREIGN PATENT DOCUMENTS

| | | |
|---|---|---|
| DE | 20 2006 016 303 | 1/2007 |
| DE | 20 2006/016304 | 1/2007 |
| DE | 20 2006 019 108 | 3/2007 |
| DE | 20 2007 010 692 | 11/2007 |
| DE | 10 2006 051 117 | 1/2008 |
| DE | 20 2008 003 248 | 6/2008 |
| DE | 20 2008 007 717 | 9/2008 |
| DE | 20 2008 008 989 | 10/2008 |

(Continued)

*Primary Examiner* — Frank Lawrence, Jr.
*Assistant Examiner* — Minh-Chau Pham
(74) *Attorney, Agent, or Firm* — Fay Kaplun & Marcin, LLP

(57) ABSTRACT

A flat bag for vacuum cleaners includes, in the interior thereof, at least two diffusers made of strips of material and/or sheet materials with oblong-shaped flow openings. Such flat bags are distinguished by excellent dust storage capacity and extension of the useful life.

26 Claims, 14 Drawing Sheets

(56) References Cited

FOREIGN PATENT DOCUMENTS

| | | |
|---|---|---|
| EP | 0 960 645 | 8/2003 |
| EP | 1 804 635 | 5/2005 |
| EP | 1 787 560 | 5/2008 |
| EP | 1 795 247 | 12/2009 |

* cited by examiner

Filter bag / retangular

Filter bag / octagonal

FLAT BAG FOR VACUUM CLEANERS

FIELD OF INVENTION

The present invention relates to a flat bag for vacuum cleaners, which has, in the interior thereof, at least two diffusers made of strips of material and/or sheet materials with oblong-shaped flow openings. Such flat bags are distinguished by excellent dust storage capacity and extension of the useful life.

BACKGROUND INFORMATION

The increase in dust storage capacity—i.e. extension of the useful life (lifespan)—of a vacuum cleaner filter bag is, in addition to improved separation power (particle retention), a substantial aim in the development of filter bags.

This can be achieved by innovative bag materials or also by the incorporation of material surfaces which influence the airflow in the filter bag. Thus EP 0 960 645 and EP 1 795 247 disclose nonwoven materials for vacuum cleaner bags having particularly good dust storage capacity.

EP 1 787 560 shows flow distributors in the form of squares or strips of material which are fitted in the region of the inlet opening of the filter bag and are able to split and deflect the incoming airflow into partial flows. In EP 1 804 635, the concept is developed with respect to a second flow distributor supplementing the function of the first flow distributor. From DE 20 2008 008 989 and DE 20 2008 003 248, combinations of two flow distributors with a spacing means are known.

From DE 20 2006 016 303, a filter bag which comprises a bag having an interior which is subdivided into at least two chambers is known. In the case of one embodiment, the subdivision is effected by a separating wall which is fixed at three side edges, a transition between the first and the second chamber being formed at the fourth side edge. In another embodiment, the separating wall is welded to the filter layers only at one side edge for the entire length and is welded on the opposite side to a strip on the upper layer made of filter material.

DE 20 2008 007 717 describes a filter bag in which a planar, multilayer filter insert which is connected at least partially to the filter bag walls is disposed in the interior. Dust is intended thereby to be incorporated between the at least two layers of the filter insert. For this purpose, the upper of the two layers can be perforated or slotted. The filter insert can be configured as a continuous strip which is fixed at two oppositely situated edges of the bag.

DE 20 2007 010 692 relates to a filter bag in which a filler layer made of fibre- or yarn material extends between the two filter walls, which layer is connected to both filter walls and, when the bag is unfolded, is pulled apart such that a net-like structure is produced in the bag.

A dust filter bag having a blocking wall part fitted in the interior is known from DE 20 2006 019 108. This blocking wall part is mounted in front of the inlet opening of the bag such that it bulges out during operation and forms two outlet openings through which the airflow is deflected. It is essential to the invention that the blocking wall part is mounted at a spacing relative to the bag seam and does not abut against the rear bag wall under the pressure of the airflow.

A further air distributor is known from DE 10 2006 051 117. At least two material layers are thereby disposed one above the other between the bag walls, the layers having less extension in a first surface direction than the two bag walls and, in the surface direction orthogonal to the first surface direction, having the same extension as the bag walls. There may be mentioned as materials, microfibre nonwoven or paper.

DE 2006 016 304 discloses a bag having at least one guide element, by means of which the incoming airflow can be deflected. The guide element is fixed adjacent to the inflow opening.

A bag already found on the market of the company Miele has an arrangement of a deflection device which is fitted directly below the inlet opening. This deflection device consists of a sheet material which is fitted directly with the upper side of the bag on both sides of the inlet opening. The purpose of this deflection device resides in deflecting the airflow which is suctioned in through the inlet opening directly in the region of the inlet opening. This deflection device is configured such that it is welded directly to the bag wall at a spacing relative to the inlet opening on the basis of a prescribed length or area. The area of this deflection device is therefore below approx. 10% of the bag surface. This filter bag is sketched in FIG. 3. However, it is problematic with these bags that, because of the relatively small dimensioning of the first deflection device (SR1), the result can be blockages of the bag due to dust accumulating between the inflow opening and the deflection device so that the bag becomes unusable.

It is however common to all the previously mentioned vacuum cleaner bags that the inflowing dirt particles are only distributed inadequately so that the result is premature blockage of the vacuum cleaner bag, which ultimately leads to reduced dust storage capacity and a clearly inadequate lifespan of the vacuum cleaner bag.

SUMMARY OF INVENTION

The present invention relates to a vacuum cleaner filter bag which ensures increased dust storage capacity and hence an extension of the useful life (lifespan). In addition, blockage of the inlet opening in the interior of the bag is intended to be prevented.

According to the invention, a flat bag for a vacuum cleaner having a bag upper side and a bag underside is hence provided, the bag walls of which are formed from an air-permeable filter material and an inlet opening for the air to be filtered being introduced in the bag upper side, at least one diffuser being provided respectively in each plane in the interior of the flat bag, below the bag upper side in a first plane and between the first plane and the bag underside in at least one further plane, the diffuser consisting of at least two strips of material and/or sheet materials, disposed next to each other, with oblong-shaped flow openings, and the diffusers being mounted on the bag wall at least on one side, with the proviso that the diffusers in the form of sheet materials with oblong-shaped flow openings which are disposed in the first plane in the region of the inlet opening and are mounted on the bag upper side on both sides and which have an area of <10%, relative to the entire bag surface, are excluded, the width of the strips of material being defined by the diameter of the inflow opening ±50%.

The diffusers which are formed from strips of material or sheet materials provided with flow openings thereby cause turbulence of the inflowing air which is laden with dirt and/or dust particles. Hence the lifespan of the bag can surprisingly be substantially extended.

Hence the flat bags according to the present invention include diffusers in at least 2 planes for turbulence of the suctioned-in dust particles. According to the invention, there is understood by a plane, a curved or uncurved surface which is disposed between the bag upper side and underside forming the bag wall. The planes in the sense of the invention are hence defined by the arrangement of the diffusers in the interior of the filter bag by connecting the diffuser at least 1 point of the bag wall. A flat bag with 2 planes is therefore constructed for example as follows:

There is thereby understood as first plane, the diffuser which is orientated towards the upper side of the bag, as second plane the diffuser which is disposed below the first plane and is orientated towards the bag underside. Any further plane is inserted between the $2^{nd}$ plane and the bag underside. The diffusers made of a floppy material are thereby formed either from at least two strips of material disposed next to each other but can also consist of sheet materials which have flow openings in the sense of slots within these sheet materials. Such sheet materials hence have at least one slot or a cut which however is not impressed continuously over the entire sheet material so that, at the ends of the sheet material, i.e. wherever there is no slotting, cohesion of the sheet material is ensured. The geometric shape of the strips of material or the geometric shapes formed by the flow openings on the sheet material is thereby essentially irrelevant; thus the strips of material can for example be structured as strips or the sheet materials by straight slots, however likewise all other possible geometric shapes of strips of material or sheet materials are possible, for example also s-shaped strips or slot guides, but also through-openings etc.

Excluded and therefore not part of the invention are embodiments of the flat bag in which diffusers in the form of sheet materials with oblong-shaped flow openings are disposed in the first plane directly below the filter bag upper side in the region of the inlet opening, these diffusers being mounted on the bag upper side on both sides and the area thereof being less than 10%, relative to the total bag surface, the width of the strips of material defined by the slots, relative to the diameter of the inflow opening, being defined at ±50%. In the case of this excluded embodiment of the flat bag, the diffuser disposed in plane 1 is therefore shorter than the total length or width of the flat bag. Both ends of the diffuser configured as a slotted sheet material in plane 1 are fixed directly on the bag upper side. The diffuser thereby covers the inlet opening completely.

It was found surprisingly that the filter bags according to the invention have an excellent dust storage capacity and hence an increased lifespan. It can likewise be observed that blockages in the region of the air inlet of the bag—as can frequently be the case in the bags known from the state of the art according to FIG. 3—could be avoided.

In an advantageous embodiment according to the invention, the strips of material are disposed moveably relative to each other; it is likewise possible that the strips of material are at a spacing relative to each other or that the flow openings of the sheet materials are dimensioned such that the resulting strips of material are at a spacing relative to each other.

It is further preferred that the width of the strips of material is 2 mm to at most 50% of the width of the bag upper side. Particularly preferred widths of the strips of material are thereby of orders of magnitude between 5 and 35% of the width of the bag. The same applies for the arrangement of the oblong flow openings relative to each other in the sheet materials, the flow openings determining the width of the strip.

It is further advantageous if the oblong-shaped flow openings of the sheet materials are linear. However, almost any geometric shapes are possible for the oblong flow openings, thus the flow openings can for example have a parallel or meandering or zigzag configuration, furthermore helical lines are likewise conceivable.

In a further advantageous embodiment, the linear, oblong flow openings have a different length within the sheet material. This embodiment of the invention is useful when at least two flow openings are present on the sheet material.

These flow openings can thereby have a different length, which leads to improved stability of the diffuser.

It is likewise preferred that the diffusers are mounted on the bag wall on both sides. In this embodiment, both diffusers, i.e. that of plane 1 and of plane 2, are hence fixed respectively on the bag upper side or bag underside. The fixing is thereby effected preferably respectively in the end region of both diffusers so that these are connected merely at points to the bag wall and are flexible in the region situated therebetween because of the floppy material and can be moved by the inflowing air.

It is likewise advantageous if the diffusers have approximately the same length and/or width as the bag upper- or underside. Fixing of the diffusers in this case can be effected then expediently by introducing the ends of the diffusers between the upper- and underside of the filter bag and fixing them together with the upper- and underside to form the finished bag. Fixing of the diffusers is thereby effected therefore at the same time as the gluing or welding step for the production of the filter bag itself. In this respect, this possibility for the fixing enables an extremely economical and simple production of the filter bag.

As an alternative embodiment hereto, it is however likewise possible that the diffusers are narrower and/or shorter than the bag upper- or underside. It is further possible here that the diffusers have a greater length and/or width than the bag upper- or underside and are present folded. Folding of the diffusers is effected expediently when the length of the diffusers is greater than the dimensioning of the length and/or width of the filter bag. Folding is then effected expediently in zigzag form, for example partial overlapping of the strips of the diffuser one above the other being effected with a diffuser in strip shape. In this respect, an increase in the engagement surface for the inflowing air is made possible, which leads to a further improvement in the properties of the filter bag.

A further embodiment of the present invention provides that the diffusers in the form of strips of material are configured turned and/or twisted. Here also, an increase in the engagement surface for the inflowing air is effected, the same advantages resulting as were described already in the folded shape of the diffusers.

It is likewise preferred that the diffusers in the form of strips of material are formed by filament bundles or bundles of foil strips. In this embodiment, the strips of material themselves are formed from a large number of filaments or threads or the like.

In particular, advantages of the present invention result if at least one diffuser in one plane is disposed relative to at least one diffuser in the next plane such that the strips of material and/or the oblong-shaped flow openings intersect. In this embodiment, the strips of material or the arrangements of sheet materials of the diffusers extend in plane 1 and plane 2 in perspective and not parallel to each other.

It is hereby particularly preferred if the intersecting diffusers are disposed orthogonally relative to each other, however also other angles of intersection of the intersecting diffusers are possible, the intersecting diffusers are therefore disposed in an arrangement which deviates from the orthogonal one.

Likewise, two diffusers respectively in one plane can be disposed respectively relative to each other such that the strips of material and/or the oblong flow openings are not disposed parallel to each other. With such an embodiment, the airflows entering into the filter bag can be made to swirl specifically.

The materials of the floppy diffusers thereby consist preferably of air-permeable materials and/or of air-impermeable materials. There are considered thereby as air-impermeable materials, in particular foils, for example plastic material foils (e.g. PE, PP). There are used as air-permeable materials, preferably laminates of air-permeable materials and/or air-impermeable materials provided with flow openings.

Furthermore, it is preferred if the diffusers are connected to the bag wall via an adhesive point and/or weld points.

In a further preferred embodiment, the flat bag is formed by two webs made of the filter material which are welded together in the edge region.

The flat bag can thereby be configured in any geometric shapes, in particular square, hexagonal or octagonal configurations are hereby possible.

It is likewise preferred if the diffusers are connected to the edge region of the flat bag.

In particular, the present flat bag according to the invention is a side-folded bag. The diffusers are hereby preferably connected to the side fold of the flat bag.

Further advantages result if the inside of the filter bag upper side has a foil (e.g. a PE foil) in the region of the air inlet opening. This foil can be glued on or welded for example. As a result, dust accumulations in the region of the inlet opening can be almost completely avoided during operation so that the closing function of the flap is not impaired.

The filter bags used in the examples are represented for illustration of the arrangement of the diffusers in the interior in the subsequently illustrated Figures. The diffusers are thereby disposed on two planes D1 and D2 in the interior of the filter bag, the plane D1 representing the plane orientated towards the filter bag upper side and the plane D2 the plane orientated towards the filter bag underside. The bags are thereby observed in projection with a view on the bag upper side from the bag underside. Provided nothing else is indicated, all the diffusers are formed from strips of a three-layered nonwoven material. In the following descriptions of the Figures, an arrangement of the diffusers "longitudinally" means a vertical arrangement of the diffusers represented in the Figures, whilst "transversely" means a horizontal arrangement of the diffusers inside the filter bag. A differentiation in this respect is necessary since the inlet opening is disposed asymmetrically relative to the centre of mass of the filter bag.

DETAILED DESCRIPTION

Figure 1:
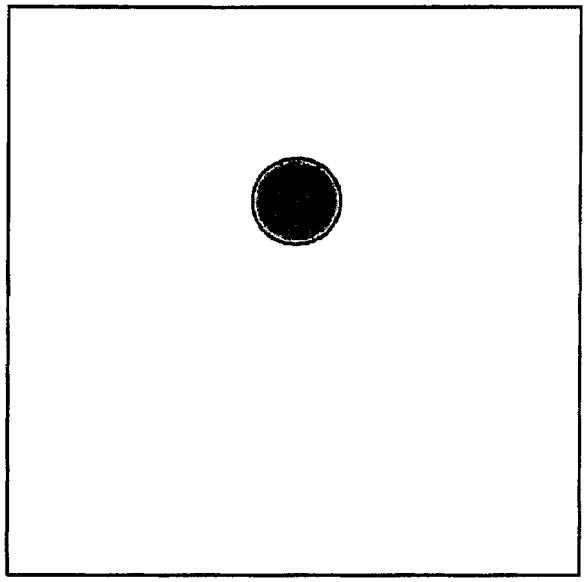
FIG. 1 shows a filter bag without diffusers in the interior (comparative example 1*).
Figure 2:
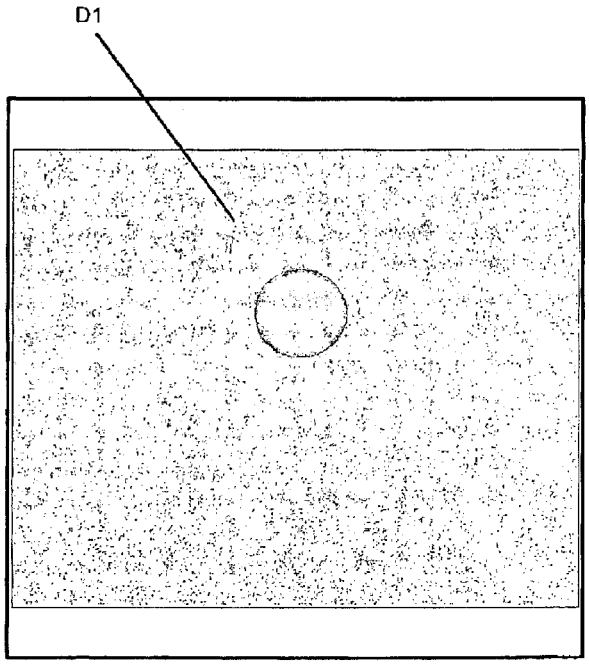
FIG. 2 shows a filter bag which contains an additional continuous layer (270 mm width) (not according to the invention, comparative example 2*). The layer D1 is thereby mounted continuously on 2 edges.
Figure 3:
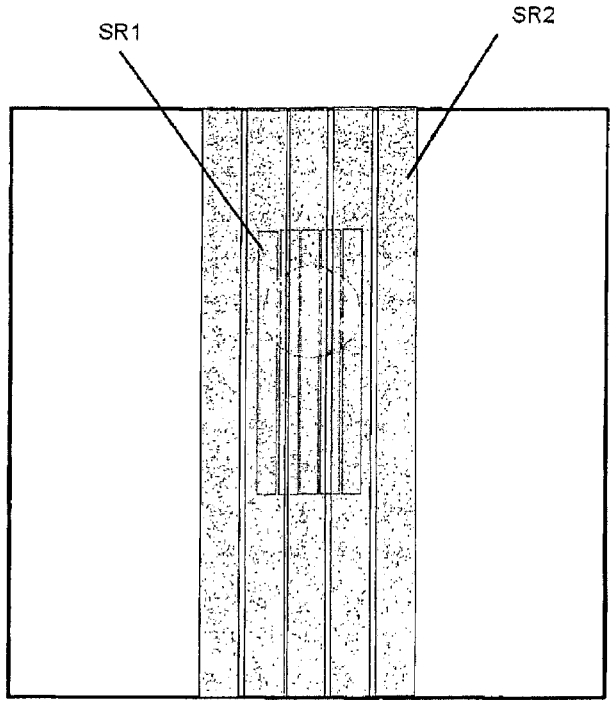
FIG. 3 shows the initially mentioned filter bag having two flow directors SR1 (5×15 mm foil) and SR2 (5×25 mm nonwoven), both flow directors being disposed longitudinally in the filter bag.
Figure 4:
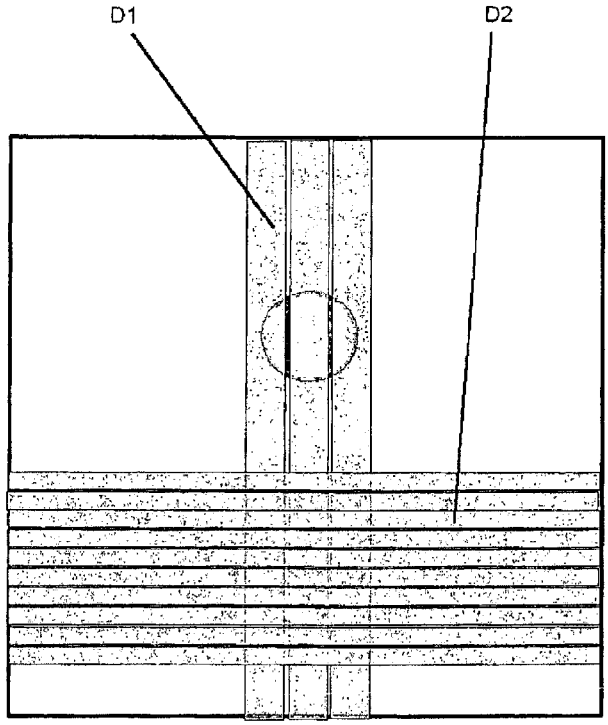
FIG. 4 shows a filter bag according to the invention having diffusers disposed in two planes D1 (3×22 mm longitudinally) and D2 (10×11 mm transversely) (example 4).
Figure 5:
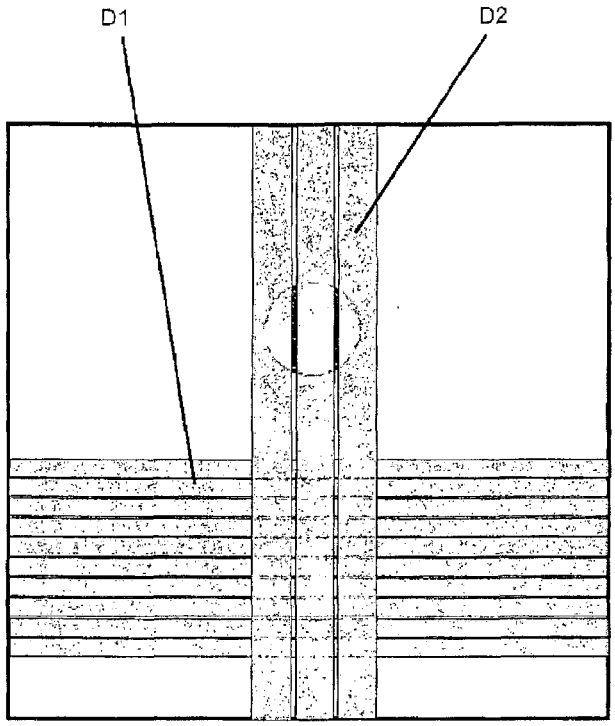
FIG. 5 shows a filter bag according to the invention having diffusers disposed in two planes D1 (10×11 mm transversely) and D2 (3×22 mm longitudinally) (example 5).
Figure 6:
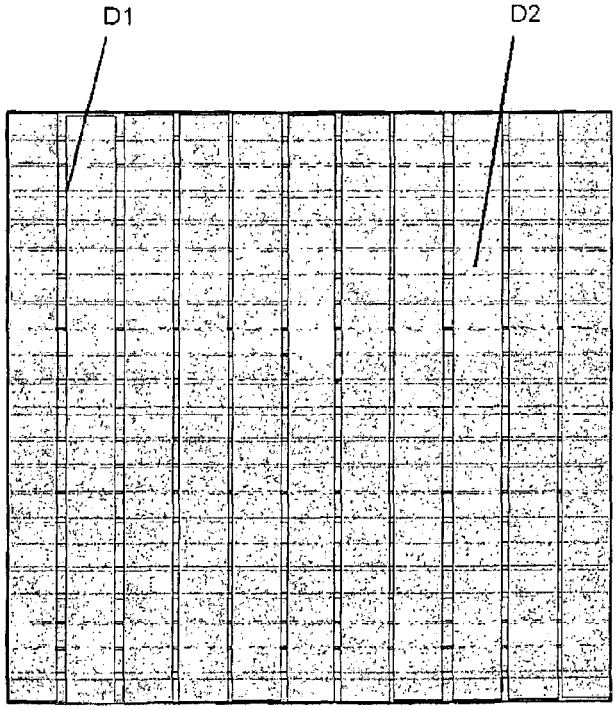
FIG. 6 shows a filter bag according to the invention having diffusers disposed in two planes D1 (22×11 mm transversely) and D2 (11×22 mm longitudinally) (example 6).
Figure 7:
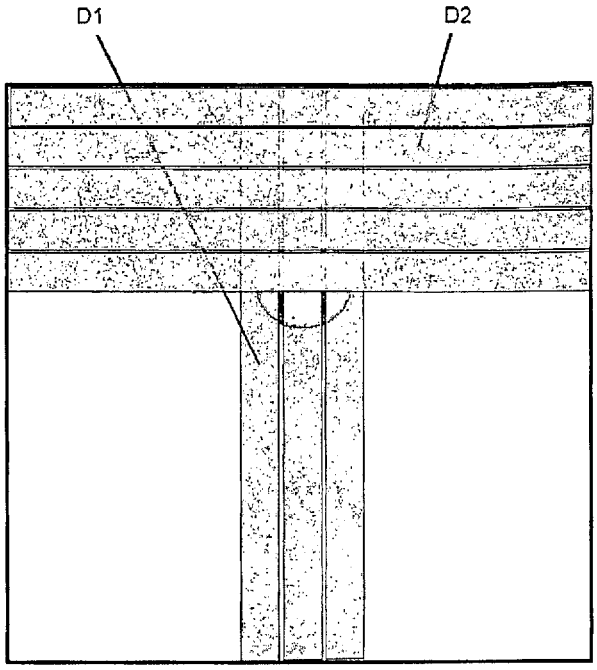
FIG. 7 shows a filter bag according to the invention having diffusers disposed in two planes D1 (3×22 mm longitudinally) and D2 (5×22 mm transversely) (example 7).
Figure 8:
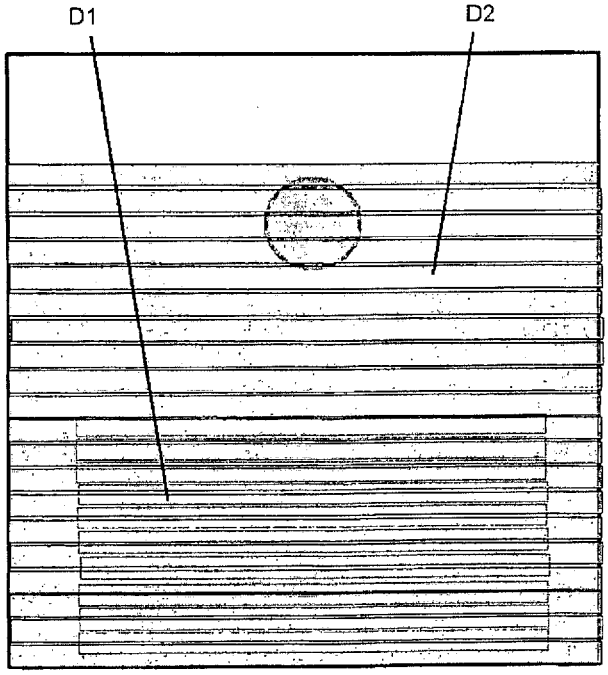
FIG. 8 shows a filter bag according to the invention having diffusers disposed respectively transversely in two planes D1 (10×11 mm) and D2 (20×11 mm) (example 8).
Figure 9:
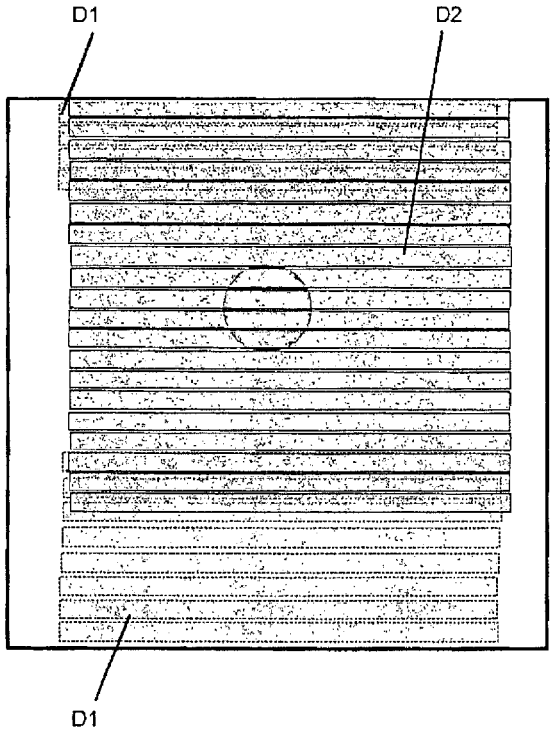
FIG. 9 shows a filter bag according to the invention having diffusers disposed respectively transversely in two planes D1 (8×11 mm at the bottom and 4×11 mm at the top) and also D2 (20×11 mm) (example 9).
Figure 10:
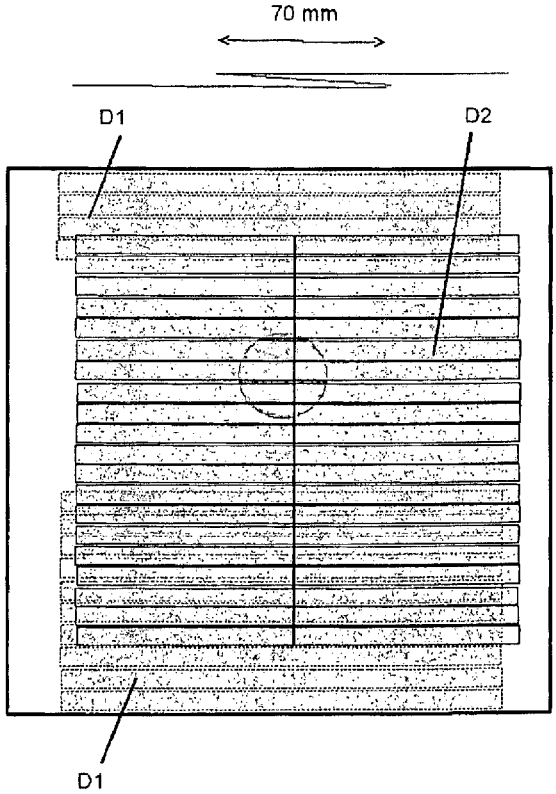
FIG. 10 shows a filter bag according to the invention having diffusers disposed respectively transversely in two planes D1 (10×11 mm at the bottom and 4×11 mm at the top) and also D2 (20×11 mm), the diffusers D2 being folded in a zigzag over a length of 70 mm (example 10).
Figure 11:
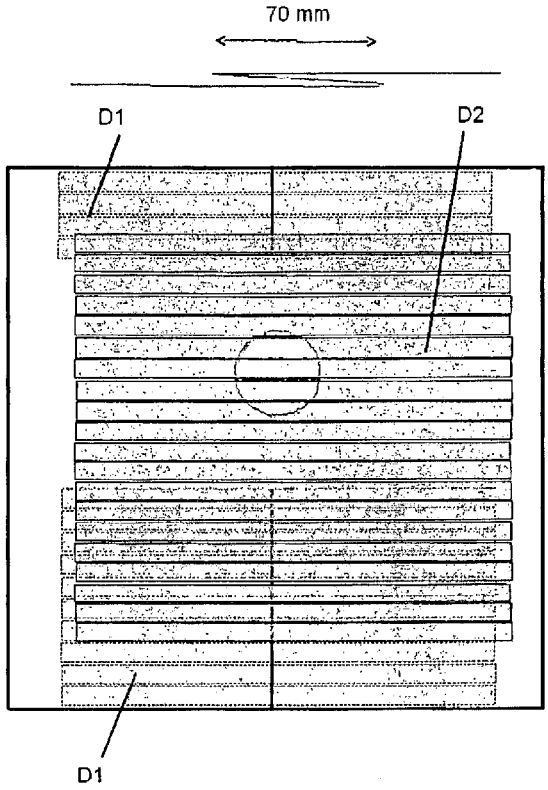
FIG. 11 shows a filter bag according to the invention having diffusers disposed respectively transversely in two planes D1 (10×11 mm at the bottom and also 4×11 mm at the top), the diffusers disposed in the plane D1 being folded in a zigzag over a length of 70 mm and also D2 (20×11 mm) (example 11).
Figure 12:
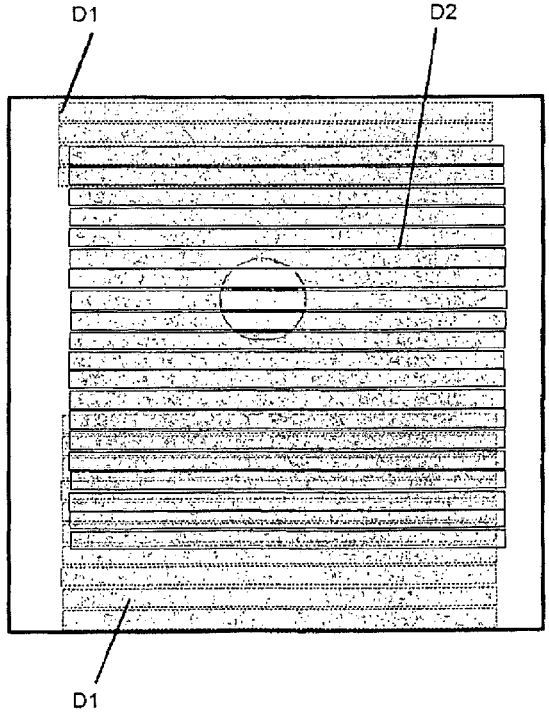
FIG. 12 shows a dust filter bag according to the invention having diffusers disposed respectively transversely in two planes D1 (10×11 mm at the bottom and 4×11 mm at the top) and also D2 (20×11 mm, disposed in the centre) (example 12).
Figure 13:
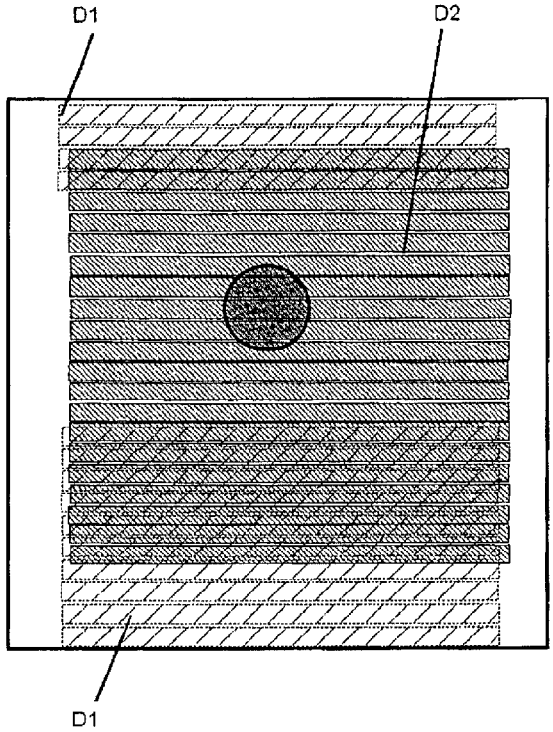
FIG. 13 shows a filter bag according to the invention having diffusers disposed respectively transversely in two planes D1 (10×11 mm at the bottom and 4×11 mm at the top) and also D2 (20×11 mm, disposed in the centre), both diffusers being formed from PE foil with a thickness of 70 μm (example 13).
Figure 14:
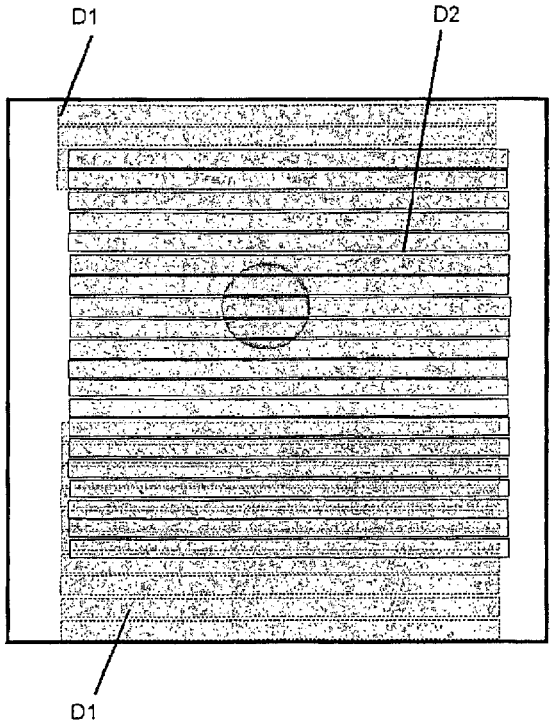
FIG. 14 shows a filter bag according to the invention having diffusers disposed respectively transversely in two planes D1 (10×11 mm at the bottom and 4×11 mm at the top) and also D2 (20×11 mm, disposed in the centre), both diffusers being formed from a perforated PE foil (example 14).
Figure 15:
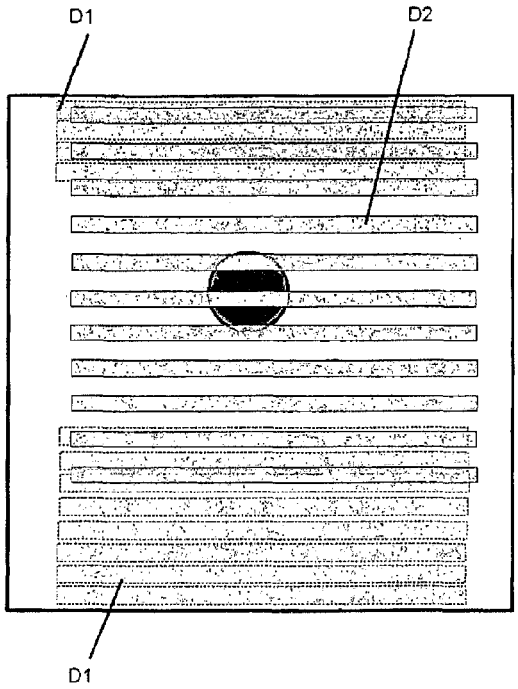
FIG. 15 shows a filter bag according to the invention having diffusers disposed respectively transversely in two planes D1 (8×11 mm at the bottom and 4×11 mm at the top) and also D2 (10×11 mm, diffusers disposed at a spacing) (example 15).
Figure 16:
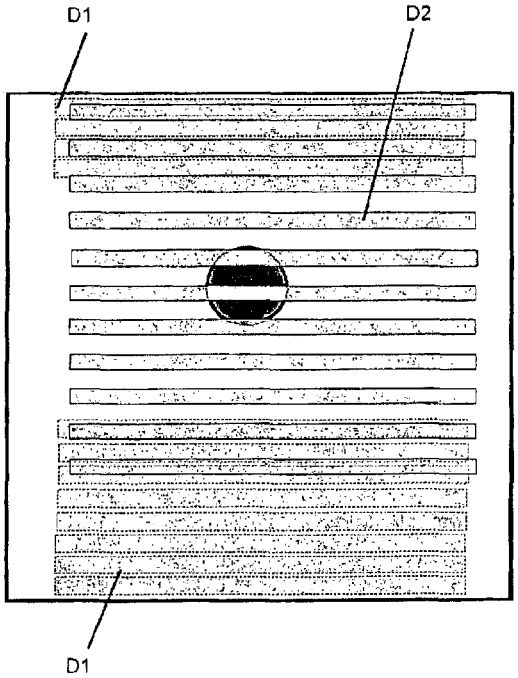
FIG. 16 shows a filter bag according to the invention having diffusers disposed respectively transversely in two planes D1 (8×11 mm at the bottom and 4×11 mm at the top) and also D2 (10×11 mm, diffusers disposed at a spacing), the end of each strip of the diffuser D2 being fitted turned or twisted by 180° relative to the other end (example 16).
Figure 17:
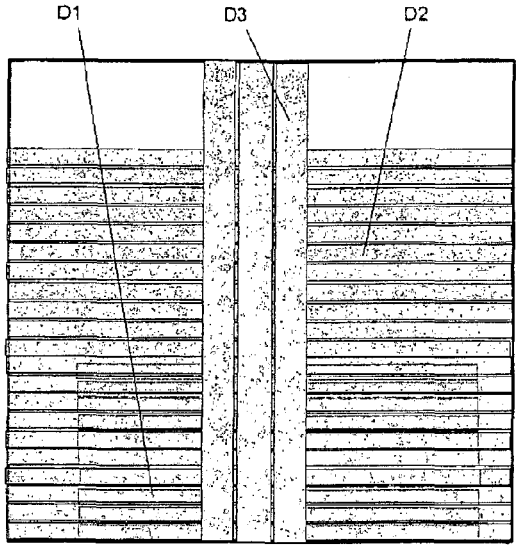
FIG. 17 shows a filter bag according to the invention having diffusers disposed in three planes D1 (10×11 mm transversely), D2 (20×11 mm transversely) and also D3 (3×22 mm longitudinally) (example 17).
Figure 18:
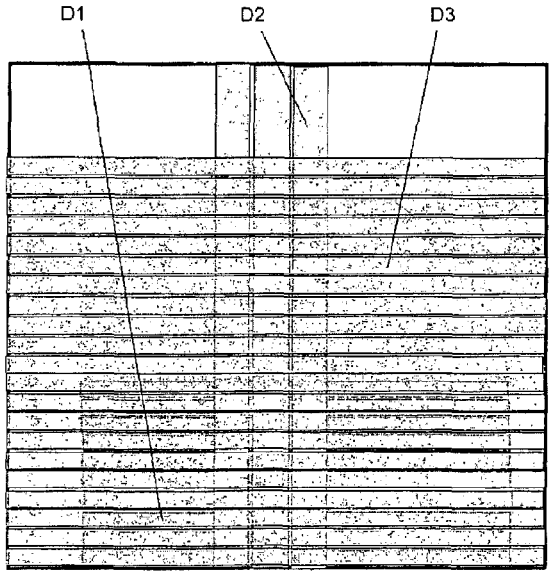
FIG. 18 shows a filter bag according to the invention having diffusers disposed in three planes D1 (10×11 mm transversely), D2 (3×22 mm longitudinally) and also D3 (20×11 mm transversely) (example 18).
Figure 19:
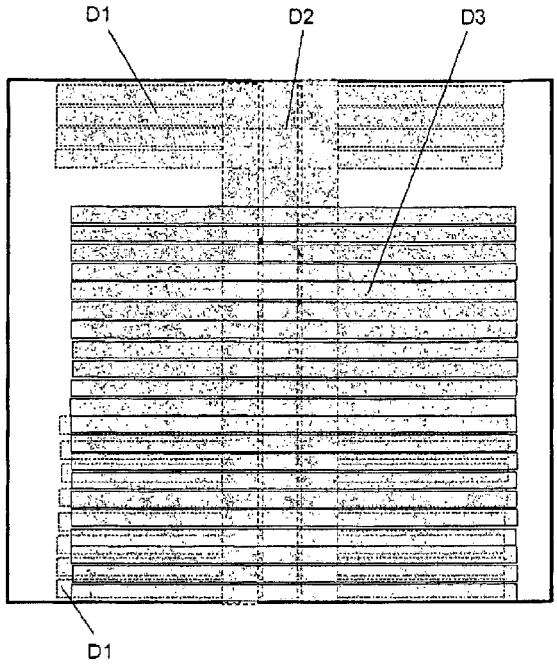
FIG. 19 shows a filter bag according to the invention having diffusers disposed in three planes D1 (8×11 mm at the bottom and 4×11 mm at the top, respectively transversely), D2 (3×22 mm longitudinally) and also D3 (20×11 mm transversely) (example 19).

The filter bags represented in FIGS. 1 to 19 (of the GN constructional type by the company Miele) were measured in a test series (implemented with a vacuum cleaner by Miele, type 5210) with defined quantities of DMT-standard dust-type 8 (50-400 g, respectively in 50 g interval steps. For this purpose, reference is made to DIN EN-ISO 60312. The obtained measurement values are indicated in Table 1 (filter bag having diffusers disposed in two planes, examples 4-16) and also table 2 (filter bag having diffusers disposed in three planes, examples 17-19). The two lower lines of the tables respectively show the measured pressure loss in % after picking up 200 or 400 g DMT-standard dust, this value being determined by the measured pressure value after picking up the respective quantity of dust, relative to the measured pressure, in the case of the dust filter bag inserted in the vacuum cleaner without having previously picked up dust. Compared with the comparative examples 1* (dust filter bag without flow directors or diffusers, see FIG. 1) and 2* (filter bag with continuous nonwoven layer, see FIG. 2), a significant improvement in pressure decrease or pressure loss can be observed with all picked-up quantities of dust. In this respect, the dust filter bags according to the invention have a significantly increased lifespan or dust pick-up capacity relative to filter bags according to comparative examples 1* and 2*. Compared with the filter bag of comparative example 3* known from the state of the art (see FIG. 3), for the most part likewise improved test results with respect to the dust storage capacity and lifespan can be established, whilst many filter bags according to the invention, with respect to the dust pick-up capacity and lifespan, are almost equal to the filter bag according to comparative example 3*. The filter bags according to the invention, relative to the filter bag according to comparative example 3*, always however offer the advantage that blockages in the region of the inlet opening can be almost completely avoided due to the very short-dimensioned flow director SR1 of the filter bag (see FIG. 3).

Figure 20:
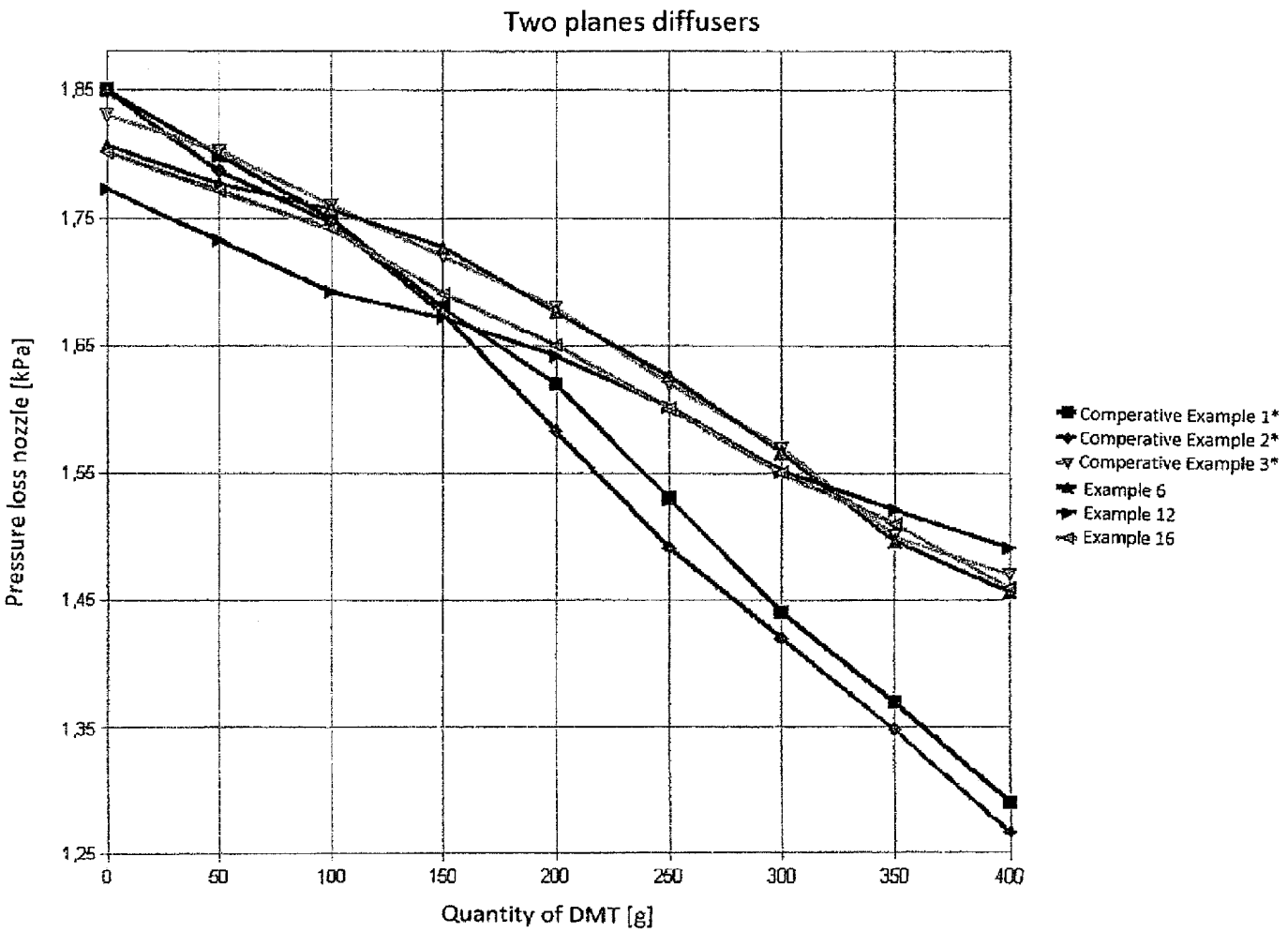
FIGS. 20 and 21 show selected test results with a filter bag according to the invention which are compared with a filter bag according to comparative examples 1* to 3*.
Figure 21:
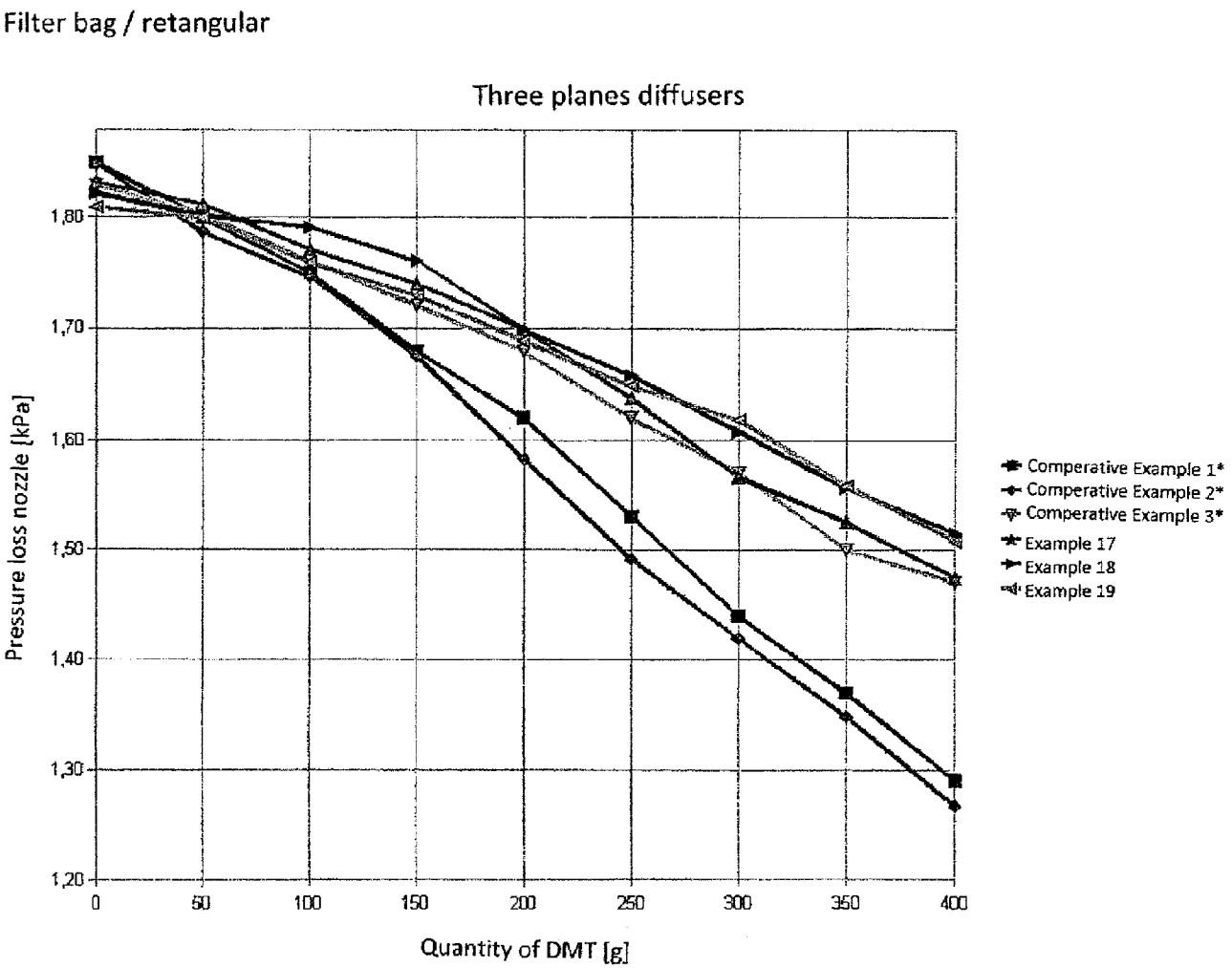

In FIGS. 20 and 21, selected test results with the filter bags according to the invention are compared with the filter bags according to comparative examples 1* to 3*. In FIG. 20, the test results of the bags having diffusers disposed in two planes are represented, the results with the bags having diffusers disposed in three planes being reproduced in FIG. 21. In both diagrams, a comparison of the obtained measurement values with comparative examples 1* to 3* takes place respectively. It can be detected clearly that the filter bags according to the invention are clearly superior to the filter bags according to comparative examples 1* and 2* with respect to the pressure decrease in the case of a previously defined picked-up quantity of dust, whilst equal results or slight improvements can be observed with respect to the filter bag according to comparative example 3*. However, it is advantageous with the vacuum cleaner filter bags according to the invention, relative to those of comparative example 3*, that the filter bags according to the invention are less inclined to form blockages in the region of the inflow opening.

Figure 22:
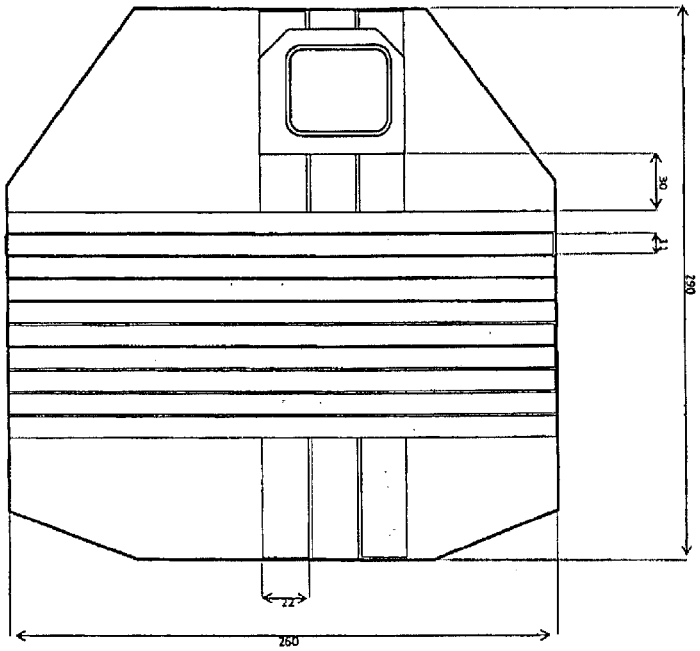
FIGS. 22 and 23 show an octagonal filter bag according to the invention.
Figure 23:
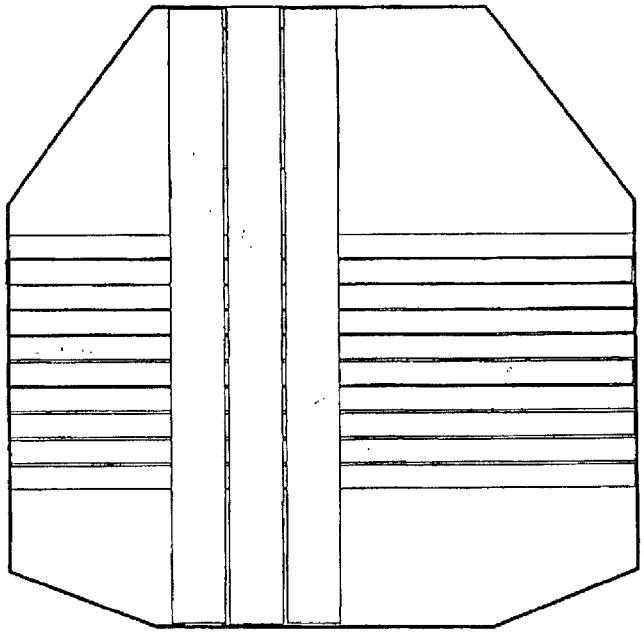

A further test series was implemented with octagonal filter bags. The basic construction of such filter bags is indicated in FIGS. 22 and 23, the basic dimensions of this type of bag being indicated in FIG. 22. The bag has a characteristic shape and can have a plurality of planes of diffusers in its interior. In FIGS. 22 and 23, respectively 2 planes of diffusers are represented: in FIG. 22, a longitudinal diffuser (3×22 mm) is fitted in plane D1 and a transverse diffuser (10×11 mm) in plane D2. The subsequently mentioned examples are derived from this prototype construction. The diffusers are also disposed in two planes D1 and D2 here, observation from the bag underside towards the bag upper side taking place here also as in FIGS. 1 to 19. The diffusers disposed in plane D1 are thereby situated orientated towards the bag upper side, whilst the diffusers situated in plane D2 are orientated towards the bag underside.

A filter bag which has no diffusers in the interior serves hereby as comparative filter bag (example 20*). The further examples are constructed as follows:

Example 21

Individual diffuser (10×11 mm transversely);

Example 22

Individual diffuser (2×22 mm transversely);

Example 23

Two diffusers D1 (3×22 mm longitudinally) and D2 (10×11 mm transversely);

Example 24

Two diffusers D1 (3×22 mm longitudinally) and D2 (10×11 mm transversely), the diffuser having a spacing of 50 mm from the lower edge of the bag;

Example 25

Two diffusers D1 (3×22 mm longitudinally) and D2 (10×11 mm transversely), the diffuser in plane D2 having a spacing of 80 mm from the lower edge of the bag;

Example 26

Two diffusers D1 (3×22 mm longitudinally) and D2 (10×11 mm transversely), the diffuser in plane D2 having a spacing of 30 mm from the lower edge of the retaining plate;

Example 27

Like example 26 but the flap of the retaining plate was removed. This test was implemented in order to test whether the closing plate protruding into the flow has an influence.

Figure 24:
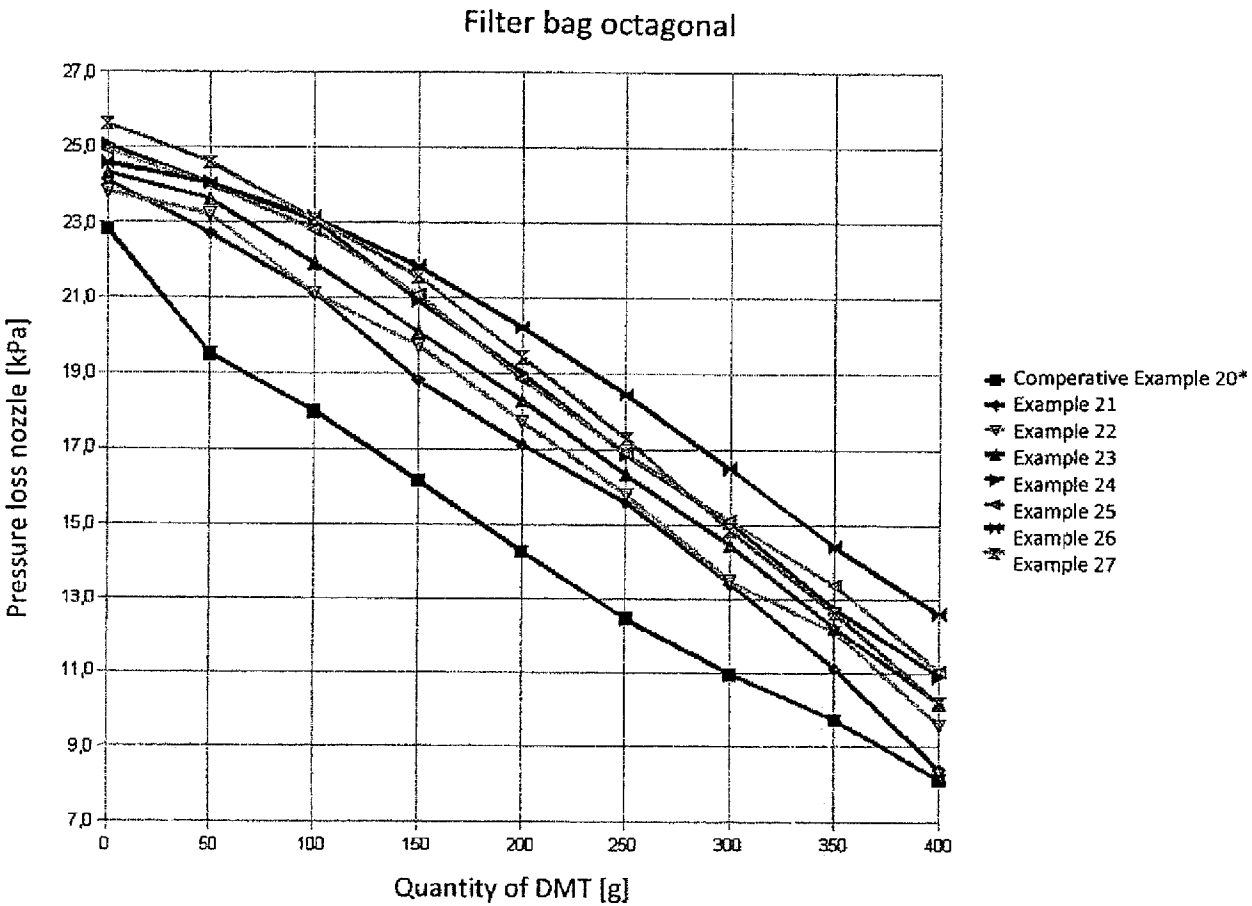
FIG. 24 shows selected results with a filter bag according to the invention which are compared with a filter bag according to comparative example 20*.

The tests with these filter bags were implemented with a vacuum cleaner Vorwerk VK140 again according to DIN EN-ISO 60312. The measured results are indicated in table 3, likewise the pressure loss as relative variable at 200 or 400 g of picked-up DMT-standard dust. As is evident from FIG. 24, the examples 21 to 27 according to the invention all have significant advantageous properties relative to comparative example 20*. In particular, it is evident that the filter bags according to the invention can pick up almost twice the quantity of dust until occurrence of a comparable pressure loss. This leads to a substantial extension in the lifespan of the filter bag.

TABLE 1

| quantity of dust [g] | Example No. 1* pressure [hPa] | 2* pressure hPa] | 3* pressure [hPa] | 4 pressure [hPa] | 5 pressure [hPa] | 6 pressure [hPa] | 7 pressure [hPa] | 8 pressure [hPa] |
|---|---|---|---|---|---|---|---|---|
| arrangement D1/D2 | | | | | orthogonal | | | parallel |
| 0 (without bag) | 1.90 | 1.90 | 1.90 | 1.85 | 1.85 | 1.89 | 1.88 | 1.89 |
| 0 | 1.85 | 1.85 | 1.83 | 1.83 | 1.82 | 1.81 | 1.85 | 1.84 |
| 50 | 1.80 | 1.79 | 1.80 | 1.80 | 1.79 | 1.78 | 1.81 | 1.80 |
| 100 | 1.75 | 1.75 | 1.76 | 1.79 | 1.76 | 1.76 | 1.78 | 1.77 |
| 150 | 1.68 | 1.67 | 1.72 | 1.73 | 1.71 | 1.73 | 1.75 | 1.74 |
| 200 | 1.62 | 1.58 | 1.68 | 1.68 | 1.67 | 1.68 | 1.68 | 1.68 |
| 250 | 1.53 | 1.49 | 1.62 | 1.62 | 1.63 | 1.63 | 1.60 | 1.64 |
| 300 | 1.44 | 1.42 | 1.57 | 1.57 | 1.57 | 1.57 | 1.53 | 1.57 |
| 350 | 1.37 | 1.35 | 1.50 | 1.50 | 1.53 | 1.50 | 1.46 | 1.49 |
| 400 | 1.29 | 1.27 | 1.47 | 1.44 | 1.46 | 1.46 | 1.39 | 1.45 |
| pressure loss | | | | | | | | |
| after 200 g | 12% | 14% | 8% | 8% | 8% | 7% | 9% | 9% |
| after 400 g | 30% | 31% | 20% | 21% | 20% | 19% | 25% | 21% |

| quantity of dust [g] | Example No. 9 pressure [hPa] | 10 pressure [hPa] | 11 pressure [hPa] | 12 pressure [hPa] | 13 pressure [hPa] | 14 pressure [hPa] | 15 pressure [hPa] | 16 pressure [hPa] |
|---|---|---|---|---|---|---|---|---|
| arrangement D1/D2 | | | | parallel | | | | |
| 0 (without bag) | 1.87 | 1.85 | 1.85 | 1.84 | 1.86 | 1.85 | 1.87 | 1.86 |
| 0 | 1.81 | 1.79 | 1.78 | 1.77 | 1.79 | 1.77 | 1.80 | 1.80 |
| 50 | 1.78 | 1.77 | 1.73 | 1.73 | 1.74 | 1.73 | 1.77 | 1.77 |
| 100 | 1.75 | 1.74 | 1.68 | 1.69 | 1.69 | 1.69 | 1.74 | 1.74 |
| 150 | 1.73 | 1.71 | 1.61 | 1.67 | 1.66 | 1.65 | 1.70 | 1.69 |
| 200 | 1.71 | 1.68 | 1.57 | 1.64 | 1.62 | 1.61 | 1.66 | 1.65 |
| 250 | 1.67 | 1.65 | 1.53 | 1.60 | 1.56 | 1.55 | 1.62 | 1.60 |
| 300 | 1.62 | 1.60 | 1.48 | 1.55 | 1.51 | 1.50 | 1.57 | 1.55 |
| 350 | 1.56 | 1.55 | 1.44 | 1.52 | 1.46 | 1.44 | 1.51 | 1.51 |
| 400 | 1.51 | 1.49 | 1.40 | 1.49 | 1.40 | 1.39 | 1.44 | 1.46 |
| pressure loss | | | | | | | | |
| after 200 g | 6% | 6% | 12% | 7% | 10% | 9% | 8% | 8% |
| after 400 g | 17% | 17% | 21% | 16% | 22% | 22% | 20% | 19% |

TABLE 2

| quantity of dust [g] | Example No. 1* pressure [hPa] | 2* pressure [hPa] | 3* pressure [hPa] | 17 pressure [hPa] | 18 pressure [hPa] | 19 pressure [hPa] |
|---|---|---|---|---|---|---|
| 0 (without bag) | 1.90 | 1.90 | 1.90 | 1.88 | 1.88 | 1.87 |
| 0 | 1.85 | 1.85 | 1.83 | 1.83 | 1.82 | 1.81 |
| 50 | 1.80 | 1.79 | 1.80 | 1.81 | 1.80 | 1.80 |
| 100 | 1.75 | 1.75 | 1.76 | 1.77 | 1.79 | 1.76 |
| 150 | 1.68 | 1.67 | 1.72 | 1.74 | 1.76 | 1.73 |
| 200 | 1.62 | 1.58 | 1.68 | 1.70 | 1.70 | 1.69 |
| 250 | 1.53 | 1.49 | 1.62 | 1.64 | 1.66 | 1.65 |

TABLE 2-continued

| quantity of dust [g] | Example No. 1* pressure [hPa] | 2* pressure [hPa] | 3* pressure [hPa] | 17 pressure [hPa] | 18 pressure [hPa] | 19 pressure [hPa] |
|---|---|---|---|---|---|---|
| 300 | 1.44 | 1.42 | 1.57 | 1.57 | 1.61 | 1.62 |
| 350 | 1.37 | 1.35 | 1.50 | 1.53 | 1.56 | 1.56 |
| 400 | 1.29 | 1.27 | 1.47 | 1.47 | 1.52 | 1.51 |
| pressure loss | | | | | | |
| after 200 g | 12% | 14% | 8% | 7% | 7% | 7% |
| after 400 g | 30% | 31% | 20% | 20% | 17% | 17% |

TABLE 3

| quantity of dust (g) | Example No. 20* Pressure [hPa] | 21 pressure [hPa] | 22 pressure [hPa] | 23 pressure [hPa] | 24 pressure [hPa] | 25 pressure [hPa] | 26 pressure [hPa] | 27 pressure [hPa] |
|---|---|---|---|---|---|---|---|---|
| 0 | 22.8 | 24.1 | 23.8 | 24.3 | 25.1 | 24.9 | 24.6 | 25.6 |
| 50 | 19.5 | 22.7 | 23.2 | 23.6 | 24.1 | 24.0 | 24.0 | 24.6 |
| 100 | 18.0 | 21.1 | 21.1 | 21.9 | 23.0 | 22.8 | 23.1 | 23.1 |

TABLE 3-continued

| | Example No. | | | | | | | |
|---|---|---|---|---|---|---|---|---|
| quantity of dust (g) | 20* Pressure [hPa] | 21 pressure [hPa] | 22 pressure [hPa] | 23 pressure [hPa] | 24 pressure [hPa] | 25 pressure [hPa] | 26 pressure [hPa] | 27 pressure [hPa] |
| 150 | 16.2 | 18.8 | 19.7 | 20.1 | 20.9 | 21.1 | 21.8 | 21.6 |
| 200 | 14.3 | 17.1 | 17.7 | 18.3 | 19.0 | 18.8 | 20.2 | 19.4 |
| 250 | 12.5 | 15.6 | 15.8 | 16.4 | 16.9 | 16.9 | 18.4 | 17.3 |
| 300 | 11.0 | 13.4 | 13.5 | 14.4 | 15.1 | 15.1 | 16.5 | 14.8 |
| 350 | 9.7 | 11.1 | 12.1 | 12.2 | 12.7 | 13.4 | 14.4 | 12.6 |
| 400 | 8.1 | 8.4 | 9.6 | 10.2 | 10.9 | 11.0 | 12.6 | 10.2 |
| pressure loss | | | | | | | | |
| after 200 g | 37% | 29% | 26% | 25% | 24% | 24% | 18% | 24% |
| after 400 g | 64% | 65% | 60% | 58% | 56% | 56% | 49% | 60% |

The invention claimed is:

1. A flat bag for a vacuum cleaner, comprising:

a bag upper side and a bag underside, bag walls of which are formed from an air-permeable filter material;

an inlet opening in the bag upper side for air to be filtered; and at least one diffuser disposed in at least one corresponding plane in the interior of the flat bag, wherein the diffuser consists of at least two strips of at least one of (a) a material and (b) a sheet material disposed next to each other with oblong-shaped flow openings, wherein at least one side of each of the diffusers is mounted on the bag wall, wherein the diffusers: (a) are formed of sheet materials with oblong-shaped flow openings, (b) are disposed in a first plane in a region of the inlet opening, (c) are mounted on the bag upper side on both sides, and (d) have an area that is greater than 10% of an area of the entire bag surface, and wherein the width of the strips of material is ±50% of a diameter of the inlet opening.

2. The flat bag according to claim 1, wherein the strips of material are disposed moveably relative to each other.

3. The flat bag according to claim 1, wherein the strips of material are at a spacing relative to each other.

4. The flat bag according to claim 1, wherein the width of the strips of material is 2 mm to at most 50% of the width of the bag upper side.

5. The flat bag according to claim 1, wherein the oblong-shaped flow openings of the sheet materials are linear.

6. The flat bag according to claim 4, wherein the linear flow openings have at least one of a parallel configuration, a meandering configuration and a zigzag configuration.

7. The flat bag according to claim 4, wherein the linear, oblong flow openings have a different length.

8. The flat bag according to claim 1, wherein the diffusers are mounted on the bag wall on both sides.

9. The flat bag according to claim 1, wherein the diffusers have approximately at least one of the same length and the same width as the bag upper- or underside.

10. The flat bag according to claim 1, wherein the diffusers are at least one of narrower and shorter than the bag upper- or underside.

11. The flat bag according to claim 1, wherein the diffusers have at least one of a greater length and a greater width than the bag upper- or underside and are present folded.

12. The flat bag according to claim 1, wherein the diffusers in the form of strips of material are configured at least one of turned and twisted.

13. The flat bag according to claim 1, wherein the diffusers in the form of strips of material are formed by one of filament bundles and bundles of foil strips.

14. The flat bag according to claim 1, wherein at least one diffuser in one plane is disposed relative to at least one diffuser in the next plane such that at least one of the strips of material and the oblong-shaped openings intersect.

15. The flat bag according to claim 14, wherein the intersecting diffusers are disposed orthogonally relative to each other.

16. The flat bag according to claim 14, wherein the intersecting diffusers are disposed in an arrangement which deviates from the orthogonal one.

17. The flat bag according to claim 1, wherein at least two diffusers in at least one plane are disposed relative to each other such that at least one of the strips of material and the oblong flow openings are not disposed parallel to each other.

18. The flat bag according to claim 1, wherein the materials of the diffusers are formed from at least one of an air-permeable material and an air-impermeable material.

19. The flat bag according to claim 18, wherein the air-impermeable material is a foil.

20. The flat bag according to claim 18, wherein the air-permeable materials are formed from at least one of a laminate of an air-permeable material and an air-impermeable material provided with flow openings.

21. The flat bag according to claim 1, wherein the diffusers are connected to the bag wall via at least one of an adhesive point and a weld point.

22. The flat bag according to claim 1, wherein the flat bag is formed by two webs made of the filter material which are welded together in the edge region.

23. The flat bag according to claim 1, wherein the flat bag has a shape of one of a square, a hexagonal and an octagonal.

24. The flat bag according to claim 2, the diffusers are connected to the edge region of the flat bag.

25. The flat bag according to claim 1, wherein the flat bag is a side-folded bag.

26. The flat bag according to claim 25, wherein the diffusers are connected to the side fold of the flat bag.

* * * * *